United States Patent [19]

Seki

[11] 4,382,582

[45] May 10, 1983

[54] AIR BLAST SLAG CUT OFF DEVICE FOR STEEL CONVERTER

[75] Inventor: Masahiko Seki, Kitakyushu, Japan

[73] Assignee: Nippon Steel Corporation, Tokyo, Japan

[21] Appl. No.: 354,339

[22] Filed: Mar. 3, 1982

[30] Foreign Application Priority Data

Mar. 10, 1981 [JP] Japan ..... 56-32296[U]

[51] Int. Cl.[3] ..... C21B 7/12

[52] U.S. Cl. ..... 266/45; 266/90; 266/272

[58] Field of Search ..... 266/45, 90, 272, 271, 266/238, 195, 273, 236; 164/154

[56] References Cited

U.S. PATENT DOCUMENTS 2,687,347 8/1954 Danulat ..... 266/272

4,079,918 3/1978 Truppe ..... 266/45

*Primary Examiner*—G. Ozaki

*Assistant Examiner*—S. Kastler

*Attorney, Agent, or Firm*—Pollock, Vande Sande & Priddy

[57] ABSTRACT

An air blast type slag cut-off device for steel converter, adapted for jetting compressed air or gas from a nozzle toward the tap hole of the steel converter to force the slag coming out of the tap hole back into the steel converter. The device has a shut-off valve disposed at a portion of the high-pressure gas pipe just upstream from and in the close proximity of the nozzle. The high-pressure gas pipe and an operating fluid supply pipe for operating the shut-off valve are connected to respective sources through a common rotary joint or through independent flexible hoses, so that the steel converter can be tilted smoothly while maintaining the fluid communication between the pipes and respective sources. The time lag of jetting of the air or gas from the nozzle is minimized thanks to the reduced length of the passage between the shut-off valve and the nozzle.

3 Claims, 9 Drawing Figures

AIR BLAST SLAG CUT OFF DEVICE FOR STEEL CONVERTER

BACKGROUND OF THE INVENTION

The present invention relates to an air blast type slag cut off device for steel converter, adapted to force back, by an application of a high-pressure gas such as pressurized air, pressurized nitrogen and so forth, the slags which tend to come out of the tap hole of the converter together with the molten steel, thereby to prevent the slag from being discharged from the steel converter.

More particularly, the invention is concerned with an improvement in the air blast type slag cut off device, in which the time lag or delay of the actual starting of the air blast after the opening of the shut-off valve for the pressurized gas.

DESCRIPTION OF THE PRIOR ART

The refining process in a steel converter is to remove impurities such as C, Si, P. S, Mn and so forth contained in pig iron and scrap, by blowing of oxygen and addition of a flux such as lime. These impurities are separated by being absorbed by the waste gas and the formed slag. The slag absorbs mainly Si, P, Sn, Mn and so forth so that the separated impurities, particularly P, is allowed undesirably returned to the molten steel to deteriorate the properties of the steel and to adversely affect the nature of steel ingot by slag inclusion, unless the formed slag is sufficiently removed and excluding during the tapping.

The demand for exclusion of the impurities is increasing in view of current spreading of the continuous casting process. This in turn gives rise to the requirement for completely eliminating inclusion of the slag into molten metal during tapping.

In the conventional air blast type slag cut-off device, as will be seen from FIG. 1, a shut-off valve for the pressurized gas is mounted on a stationary pipe at a position 7 to 10 m away from the nozzle. Therefore, this conventional device inevitably suffers a time lag of about 0.7 to 1 second until the pressurized air completely fills the stationary pipe of 7 to 10 m long to burst out of the nozzle to actually force back the flowing slag into the tap hole, after the supply of the pressurized gas is started by opening the shut-off valve upon sensing of the flowing out of the slag. In consequence, a part of the slag inevitably flows into the molten steel to deteriorate the quality of the steel ingot.

In view of the aforementioned current demand, this problem is considered to be of substantial seriousness. Namely, in addition to the above-mentioned time lag of 0.7 to 1 seconds attributable to the length of pipe in which the gas flows, the following time lags are inevitable in the actual operation of the steel converter: namely, a detection lag until the valve opening signal is issued after detection of flow of slag following the molten steel visually or by means of a matter, a transfer lag until the signal is transferred to the valve and the valve action delay until the valve is sufficiently opened upon receipt of the valve opening signal. The sum of the detection lag, transfer lag and the valve action delay is about 0.5 second. Thus, the total time lag is as large as 1.2 to 1.5 second so that a considerably large amount of slag is conveniently discharged to merge in the molten steel.

SUMMARY OF THE INVENTION

Accordingly, an object of the invention is to provide an air blast slag cut-off device in which the shut-off valve for the pressurized gas is disposed in the vicinity of the nozzle so that the time lag until the pressurized gas is discharged after the detection of the slag flowing out of the tap hole is substantially eliminated, thereby to overcome the above-described problems of the prior art.

To this end, according to the invention, there is provided an air blast type slag cut off device for steel converter comprising: a pressurized gas pipe adapted to supply a prezzurized gas nozzle directed toward the tap hole of a steel converter, a shut-off valve for selectively shutting off the flow out of the pressurized gas and disposed in the position of the pressurized gas pipe in the vicinity of the nozzle, and an operation fluid supply pipe for supplying a fluid for operating the shut-off valve, the operation fluid supply pipe being connected to the shut-off valve through a rotary joint attached to the trunnion shaft of the converter or through a flexible hose.

DESCRIPTION OF THE PREFERRED EMBODIMENTS

Figure 2:
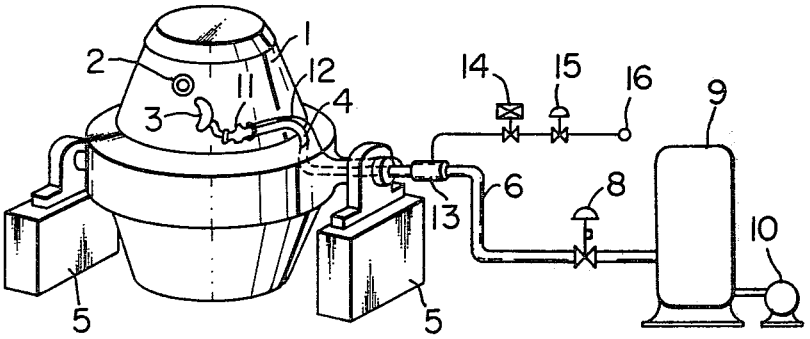
FIG. 2 is a perspective view of an air blast type slag cut-off device in accordance with an embodiment of the invention.

The invention will be fully described hereinunder through preferred embodiments with reference to the attached drawings. Referring to FIG. 2, an air blast type slag cut off device in accordance with an embodiment of the invention has a nozzle 3 adapted to jet pressurized gas such as compressed air, nitrogen or the like toward the tap hole 2 of a steel converter. The nozzle 3 is connected through a furnace air pipe 4 to the outlet pipe (not shown) of a rotary joint 13 on the trunnion shaft. A shut-off valve 11 is disposed at a portion of the air pipe 4 disposed at immediately upstream side from the nozzle 3. On the other hand, the inlet pipe of the rotary joint 13 is connected to an air introduction pipe 6 connected through an air receiver 9 to a source 10 of compressed air. A pressure regulating valve 8 is disposed at an intermediate portion of the air introduction pipe 6.

The shut-off valve 11 is adapted to be operated by a fluid which is supplied through an operating fluid supply pipe 12. The operation fluid supplying pipe 12 is connected through the rotary joint 13 and via an operation solenoid valve 14 and a pressure reducing valve 15, to a source 16 of the operating fluid. In some case, the operating fluid supply pipe 12 is prepared in double.

Only one of such pipes is shown for clarification of the drawing.

Figure 3:
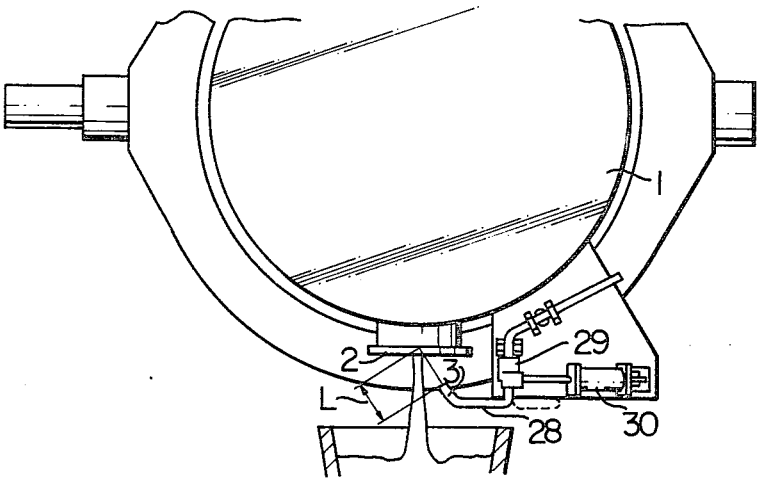
FIG. 3 shows the detail of an example of a nozzle in the device shown in FIG. 2, in the position in which the steel converter is inclined.
Figure 4:
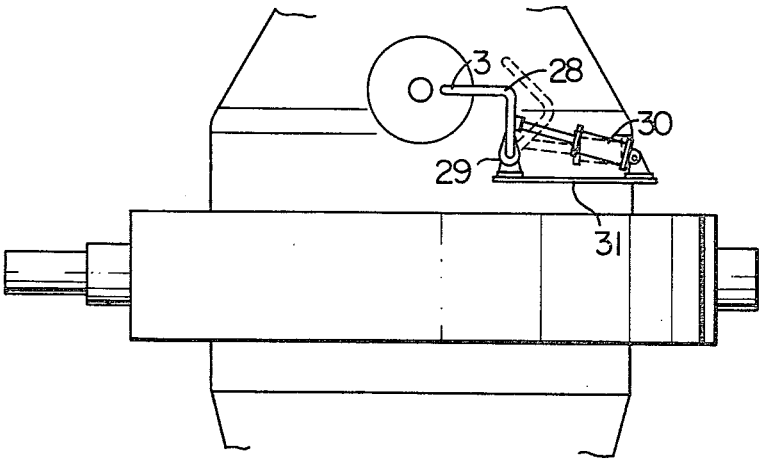
FIG. 4 is a front elevational view of the nozzle shown in FIG. 3.

FIGS. 3 and 4 show the detail of the nozzle portion of the device shown in FIG. 2. More specifically, FIG. 3 shows the construction of the nozzle portion in the state where the steel converter is inclined, while FIG. 4 is a front elevational view of the same. Usually, the nozzle portion is set at the retracted position shown by broken line in FIG. 4. The nozzle portion is held at this position even during tapping, in order to avoid splash. Immediately before the completion of tapping, the nozzle is set at the operative position shown by full line, and is operated to apply a jet of the compressed gas when the discharge of the slag is observed.

The nozzle 3 for jetting the compressed gas is connected to a swingable pipe 28 which in turn is connected through the rotary joint 29 to the air pipe 4 on the converter body. The swingable pipe 28 together with the jetting nozzle 3 is adapted to be swung by means of a swinging cylinder. Namely, the nozzle 3 and the rotary pipe 28 as a unit are swung around the rotary joint 29 as the piston of the swinging cylinder 30 is extended and retracted. The swinging cylinder 30 and the rotary joint 29 are mounted on a bracket 31 which in turn is fixed by welding to the steel converter 1.

Figure 5:
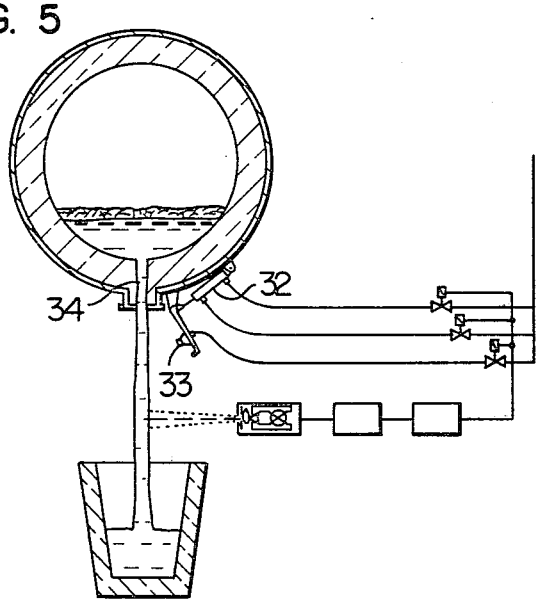
FIGS. 5 and 6 are illustrations of conventional slug cut off method for the tap hole of a steel converter.
Figure 6:
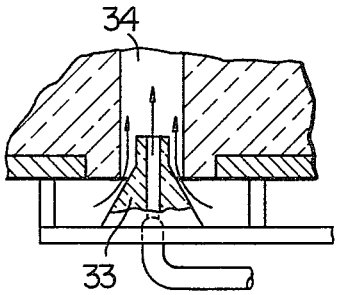

In this connection, attention must be drawn to FIGS. 5 and 6 showing a conventional system resembling that of the invention explained above. In this conventional system, a cylinder 32 starts to operate only after the detection of the slag flowing out of the tap hole subsequently to the molten metal, to swing a nozzle 33 into the tap hole 34 thereby to complete the operation. Therefore, most of the time period between the moment of detection and the cut off of the slag is occupied by the time required for the operation of the cylinder 32. The length of time required for the operation of the cylinder is about 1 second at the shortest. A too fast motion of this cylinder will cause a damage on the cylinder due to inertia, so that there is a practical limit in shortening the operation time.

In the steel converter used hitherto, the tap hole 34 is worn thereby to increase its diameter during a long use. In fact, the tap hole diameter which is 150 mm$\phi$ at the beginning will soon increase to 300 mm$\phi$ at the end period of running. In addition, the wear of the tap hole does not proceed uniformly over the entire circumference of the tap hole, so that the shape of the tap hole approaches oval as the steel converter is used long. The worn tap hole having an oval shape adversely affects the slag cutting performance.

It is remarkable that these problems are completely eliminated and a high slag cutting performance is ensured by the present invention.

Namely, the nozzle in the slag cut off device of the invention is characterized by being of noncontacting type. Namely, as will be seen from FIG. 3, the nozzle 3 does not directly contact the molten metal flowing out of the tap hole nor the tap hole itself. More specifically, the position of the nozzle at the time of completion of the tapping is so selected that the nozzle opposes to the tap hole at an angle $\theta$ of 20° to 70° and that the distance L from the tap hole ranges between 200 and 700 mm, so that the nozzle never contacts the flow of the molten steel. According to the invention, therefore, it is possible to check the discharge of the slag in quite a short period of time required for the jetting of the compressed gas. In order to further shorten the time length for cutting off the slag to achieve a higher slag cut-off performance, according to the invention, it is possible to dispose a shut-off valve 11 in close proximity of the nozzle.

Figure 7:
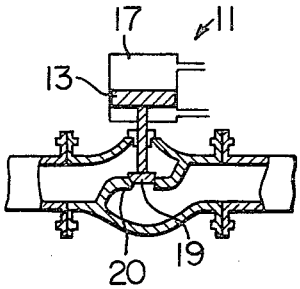
FIG. 7 is a sectional view of an example of a shut-off valve of the present invention.

FIG. 7 shows the construction of the shut-off valve 11 operated by compressed air as in the case of the embodiment shown in FIG. 2. The shut-off valve 11 has a valve member 19 adapted for cooperating with a valve seat 20 in opening and closing the valve 11. The valve member 19 is directly connected to a piston 18 in a cylinder 17.

Figure 1:
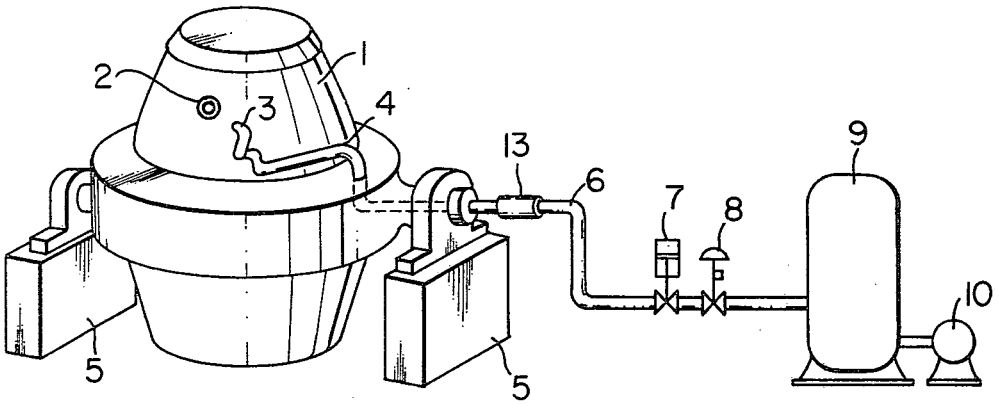
FIG. 1 is a perspective view of a conventional air blast type slag cut off device for steel converter.
Figure 8:
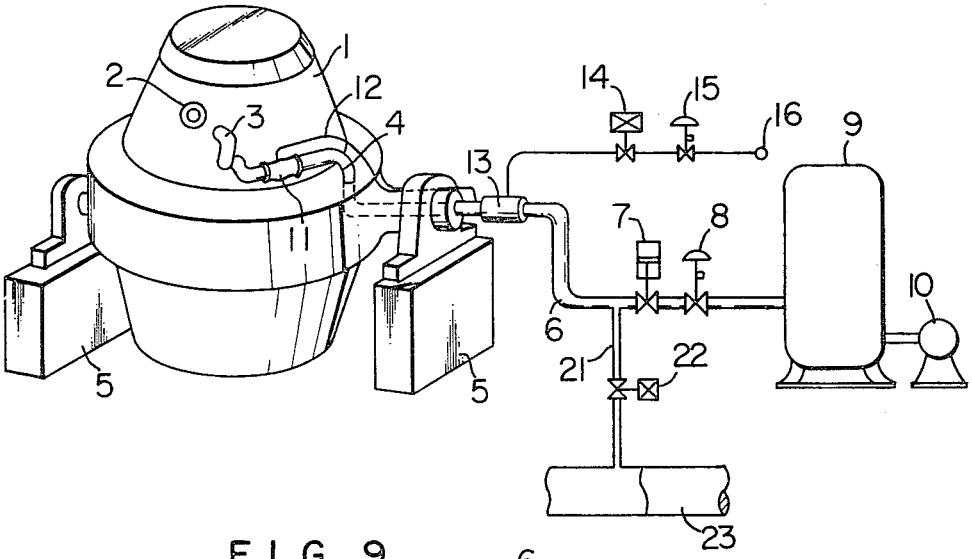
FIGS. 8 and 9 are perspective views of embodiments different from that shown in FIG. 2.

FIG. 8 shows another embodiment in which, in addition to the shut-off valve 11 disposed in the close proximity of the nozzle 3, a pilot shut-off valve 7 is disposed in the stationary pipe as in the case of the shut-off valve in the prior art shown in FIG. 1. In this embodiment, in order to eliminate the time lag of cutting off of the flow of the slag attributable to the large distance of 7 to 10 m between the nozzle 3 and the pilot shut-off valve 7, the air introduction pipe 6 and, hence, the air pipe 4 are connected, through a low-pressure air pipe 21 having an intermediate low-pressure air shut-off solenoid valve 22, to a main pipe 23 of low pressure air of a pressure ranging between 3 and 7 ata usually available in factories. The solenoid valve 22 is used for normally charging the space in the pipe between the pilot shut-off valve 7 and the shut-off valve 11 in the vicinity of the nozzle 3 up to a pressure of 3 to 7 ata. The shut-off valve 7 and 11 are kept closed up to the moment immediately before the cutting off of the flow of slag, while the solenoid valve 22 is kept opened.

In the operation for cutting off the flow of the slag, the pilot shut-off valve 7 and the shut-off valve 11 are opened simultaneously, while the solenoid valve 22 is closed to prevent the high pressure air coming from the receiver from flowing back into the low pressure air main pipe 23 of the air supply system in the factory.

The rotary joint used in the device of the invention may of the type disclosed in Japanese Patent Application No. 144949/79 filed by the same applicant as this application. Namely, the rotary joint used in the invention should be constructed to permit the supply of different kinds of fluid simultaneously.

Figure 9:
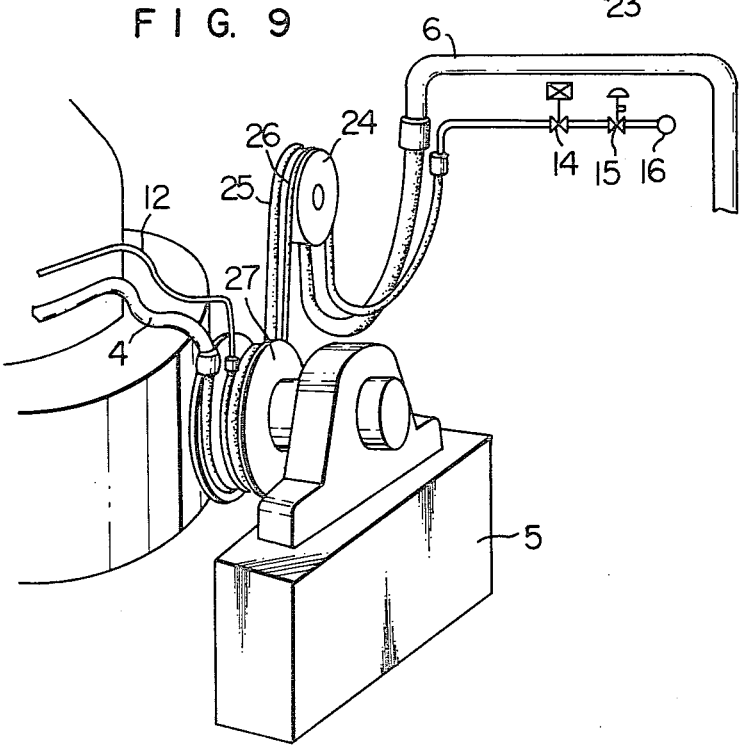

FIG. 9 shows another embodiment of the invention in which flexible hoses 25 and 26 are used in place of the rotary joint 13 in the preceding embodiment. Namely, in this embodiment, the furnace air pipe 4 and the air introduction pipe 6 are connected to each other by the flexible hose 25, and the operating fluid supply pipe 12 is connected to the shut-off valve through the flexible hose 26, so that the steel converter can be inclined smoothly while maintaining the fluid communication between the shut-off valve and the source of the compressed gas. A reference numeral 27 denotes a hose take-up drum, while 24 designates a pulley. As the steel converter is tilted, the flexible hoses 25 and 26 are taken-up the hose take-up drum 27 mounted on the trunnion shaft. It is thus possible to tilt the steel converter while maintaining satisfactory fluid communication.

In the operation of the slag cut-off device of the embodiment shown in FIG. 2, the furnace air pipe 4 and the air introduction pipe 6 are beforehand charged with air of a pressure of 3 to 7 atm regulated by the pressure regulating valve 8. As the discharge of the slag from the tap hole following the flow of molten metal is detected, the operating solenoid valve 14 is activated to open the shut-off valve 11 thereby to let the compressed air go out of the compressed gas jetting nozzle 3.

As has been described, in the slag cut-off device of the invention, the distance between the nozzle 3 for jetting the pressurized gas and the shut-off valve 11 is much smaller than that between the nozzle and the shut-off valve 7 disposed in the stationary pipe of the conventional slag cut-off device shown in FIG. 1. According to the invention, therefore, it is possible to jet the compressed gas from the nozzle 3 substantially concurrent with the opening of the shut-off valve 11.

For operating the slag cut-off device without fail, it is necessary that a predetermined air pressure is maintained in the receiver 9 by the supply of compressed air from the compressed air source. If there is a leak of air in, for example, a valve in the air pipe, the pressure in the reciever is inconveniently lowered resulting in a wasteful use of the compressed air. In the embodiment shown in FIG. 2, therefore, it is necessary that the shut-off valve 11 is constructed to completely eliminate the leak of air. Considering that the shut-off valve 11 is used in the area close to the steel converter where the temperature is very high, it is necessary to use, as the shut-off valve 11, a valve having a high performance and being designed and constructed to eliminate any leak of air.

The embodiment shown in FIG. 8, however, is entirely free from the problem of leak because, in this case, there is a continuous supply of low pressure air to the upstream side of the shut-off valve 11. Namely, all what required is that the shut-off valve 11 is opened promptly with minimum delay, and a slight leak of air therethrough is permissible. In the embodiment shown in FIG. 8, the preservation of the pressure in the receiver is ensured by the pilot shut-off valve 7. The pilot shut-off valve need not be of quick response type. Namely, a certain time lag until the pilot shut-off valve 7 is fully opened is permissible. Meanwhile, the low pressure air is supplied from the low pressure air circuit to pre-charge the air blow line of the air blow type slag cut-off device.

Thus, the embodiment shown in FIG. 8 offers advantages such as easy availability of the valve due to less strict requirement for leak-proof structure, increased reliability of operation of the air blast type slag cut-off device as a whole and so forth, although the construction is somewhat complicated as compared with the embodiment shown in FIG. 2.

The embodiment shown in FIG. 8 can be embodied even in such a factory as having a small margin of capacity of low-pressure air source, because the low pressure air is used only for charging the limited space in the furnace air pipe 4 between the shut-off valve 11 and the pilot shut-off valve 7 and in the introduction air passage 6 so that the consumption of low-pressure air is negligibly small. In ordinary factories, such low-pressure air line 23 is laid everywhere in the factory, so that the arrangement shown in FIG. 8 can be realized economically and simply by connecting the slag cut-off device to the low-pressure air line 23 through the low-pressure air pipe 21. In consequence, with the arrangement shown in FIG. 8, it is possible to attain a higher reliability of operation than in the embodiment shown in FIG. 2, at a comparatively low cost.

The fluid-operated shut-off valve used in the embodiments described heretofore is not exclusive, and it is possible to use hydraulically operated valve, pneumatically operated valve and solenoid-operated valve as the shut-off valve disposed in the close proximity of the nozzle. The piping for operating fluid can be eliminated when the solenoid operated valve is used. Considering that the shut-off valve 11 is mounted on the converter body or placed in the close proximity of the same together with the nozzle 3, the shut-off valve may be of water-cooled type or suitably protected against heat.

What is claimed is:

1. An air blast type slag cut-off device for steel converter, having a nozzle for jetting a pressurized gas toward the tap hole of said steel converter thereby to force the slag tending to accompany the molten steel back into said steel converter, said device comprising: a shut-off valve disposed in a high-pressure gas pipe to which said nozzle is connected, said shut-off valve being arranged in the close proximity of said nozzle and substantially mounted on said steel converter; an operating fluid supply pipe connected at its one end to said shut-off valve and at its the other end to a pipe leading from the source of an operating fluid for operating said shut-off valve; and a rotary joint for connecting said operating fluid supply pipe and said high-pressure gas pipe to respective sources and provided on the trunnion shaft of said steel converter and adapted to permit said steel converter to be tilted smoothly while maintaining fluid communication between said pipes and respective sources, whereby the time lag of jetting of said pressurized fluid from said nozzle can be prevented.

2. An air blast type slag cut-off device for steel converter, having a nozzle for jetting a pressurized gas toward the tap hole of said steel converter to force the slag tending to accompany the molten steel back into said steel converter as claimed in claim 1, characterized by comprising: a pilot shut-off valve disposed at a portion of a high-pressure gas pipe to which said nozzle is connected upstream from said trunnion shaft of said steel converter and downstream but downstream from a pressure regulating valve; and a low-pressure air pipe connected to the portion of the high-pressure gas pipe between said trunnion shaft and said pilot shut-off valve and leading from a low-pressure air line in the factory, said low-pressure air pipe being provided with a valve normally opened to charge said high-pressure air pipe with the low-pressure air supplied from said low-pressure air line in the factory.

3. An air blast type slag cut-off device for steel converter as claimed in either one of claims 1 or 2, wherein the high-pressure gas pipe connected to said shut-off valve includes a flexible hose, while the operating fluid pipe for supplying said shut-off valve with an operating fluid includes another flexible hose, said hoses being adapted to be taken-up by at least one take-up drum when said steel converter is tilted thereby to permit a smooth tilting of said steel converter.

* * * * *